US006481617B2

(12) United States Patent
Yang

(10) Patent No.: US 6,481,617 B2
(45) Date of Patent: Nov. 19, 2002

(54) BARREL

(76) Inventor: Zhi-Yuan Yang, 58, Ma Yuan West St., Taichung (TW)

( * ) Notice: Subject to any disclaimer, the term of this patent is extended or adjusted under 35 U.S.C. 154(b) by 98 days.

(21) Appl. No.: 09/815,581

(22) Filed: Mar. 21, 2001

(65) Prior Publication Data

US 2002/0124481 A1 Sep. 12, 2002

(30) Foreign Application Priority Data

Jul. 7, 2000 (TW) ..... 89211924 U

(51) Int. Cl.[7] ..... B65D 5/00

(52) U.S. Cl. ..... 229/103; 229/108; 362/351; 362/352; 206/736

(58) Field of Search ..... 52/64, 79.1, 79.4, 52/79.5, 143, 311.1, 311.2; 229/103, 108, 110, 198; 206/736; 446/71, 75; 362/351, 352

(56) References Cited

U.S. PATENT DOCUMENTS 1,649,088 A * 11/1927 Tinsley ..... 229/108
1,861,206 A * 5/1932 Burgess ..... 229/103
2,962,159 A * 11/1960 Sheard ..... 206/527
3,571,958 A * 3/1971 Stevens et al. ..... 40/124.1
4,359,182 A * 11/1982 Perkins, Jr. ..... 229/45 R
4,798,747 A * 1/1989 Laramee ..... 428/12
6,431,435 B1 * 8/2002 Jones et al. ..... 229/117.28

* cited by examiner

*Primary Examiner*—Carl D. Friedman
*Assistant Examiner*—Jennifer I. Thissell

(57) ABSTRACT

A barrel has a sector-shaped main board and a polygonal base board. A plurality of periphery plates are disposed on a periphery of the polygonal base board. Each periphery plate has a periphery folding line and a round hole. The sector-shaped main board has a plurality of longitudinal folding lines, a connection plate, a plurality of rectangular plates, and a plurality of decoration plates. Each rectangular plate has a slot. Each decoration plate has a transverse folding line and an insertion protrusion. The connection plate and one of the rectangular plates are fastened together. Each periphery plate and each rectangular plate are fastened together by a bolt and a nut.

1 Claim, 5 Drawing Sheets

BARREL

BACKGROUND OF THE INVENTION

The present invention relates to a barrel. More particularly, the present intention relates to a barrel which can be converted into a lamp shade.

A conventional barrel occupies a large room while transporting. A plurality of conventional barrels occupy larger rooms while transporting.

SUMMARY OF THE INVENTION

An object of the present invention is to provide a barrel which can be converted into a lamp shade.

Another object of the present invention is to provide a barrel which can be detached to occupy a small room while transporting.

Accordingly, a barrel comprises a sector-shaped main board and a polygonal base board. A plurality of periphery plates are disposed on a periphery of the polygonal base board. Each of the periphery plates has a periphery folding line and a round hole. The sector-shaped main board has a plurality of longitudinal folding lines, a connection plate and a plurality of rectangular plates defined by the longitudinal folding lines, and a plurality of decoration plates connected to the rectangular plates. The connection plate has a plurality of round apertures. Each of the rectangular plates has a slot and at least a circular aperture. Each of the decoration plates has a transverse folding line and an insertion protrusion. The sector-shaped main board is folded along the longitudinal folding lines. The connection plate and one of the rectangular plates are fastened together. Each of the decoration plates is folded along the transverse folding line and the insertion protrusion of the decoration plate is inserted in the corresponding slot of the rectangular plate. Each of the periphery plates is folded upward along the periphery folding line to match the corresponding rectangular plate. Each of the periphery plates and each of the rectangular plates are fastened together by a bolt and a nut engaging with the bolt.

DETAILED DESCRIPTION OF THE INVENTION

Figure 1:
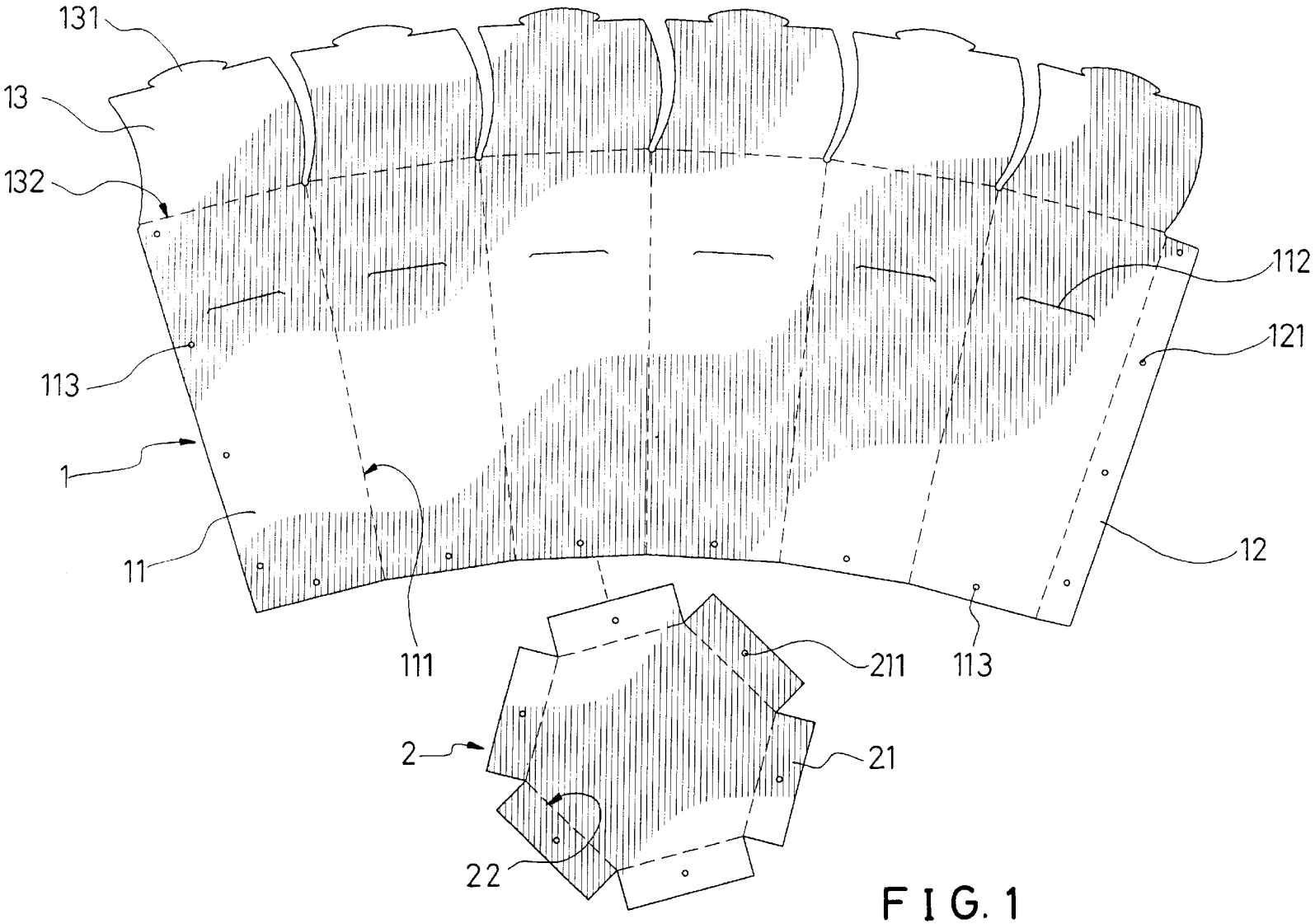
FIG. 1 is a perspective exploded view of a barrel of a preferred embodiment in accordance with the present invention.
Figure 2:
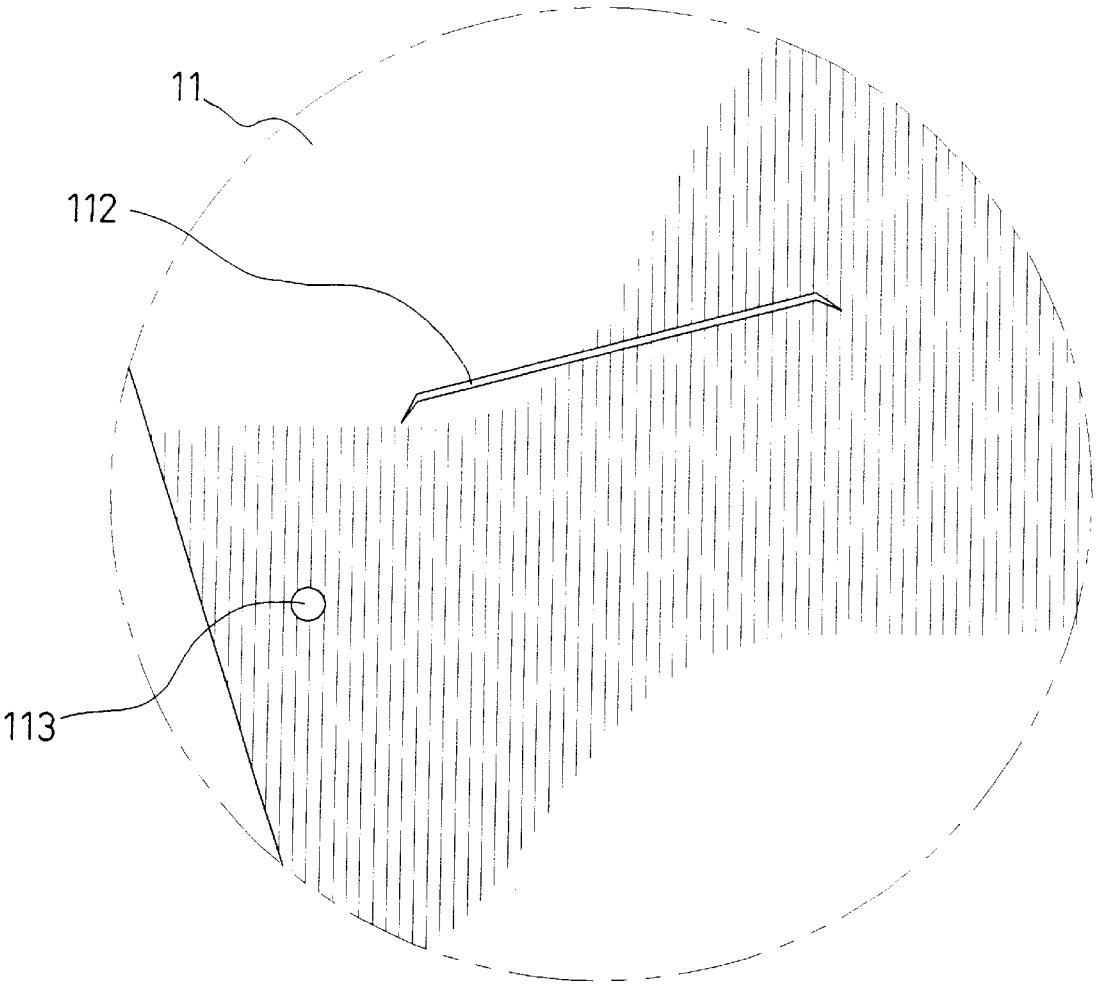
FIG. 2 is a partially enlarged view of a sector-shaped main board of a preferred embodiment in accordance with the present invention.
Figure 3:
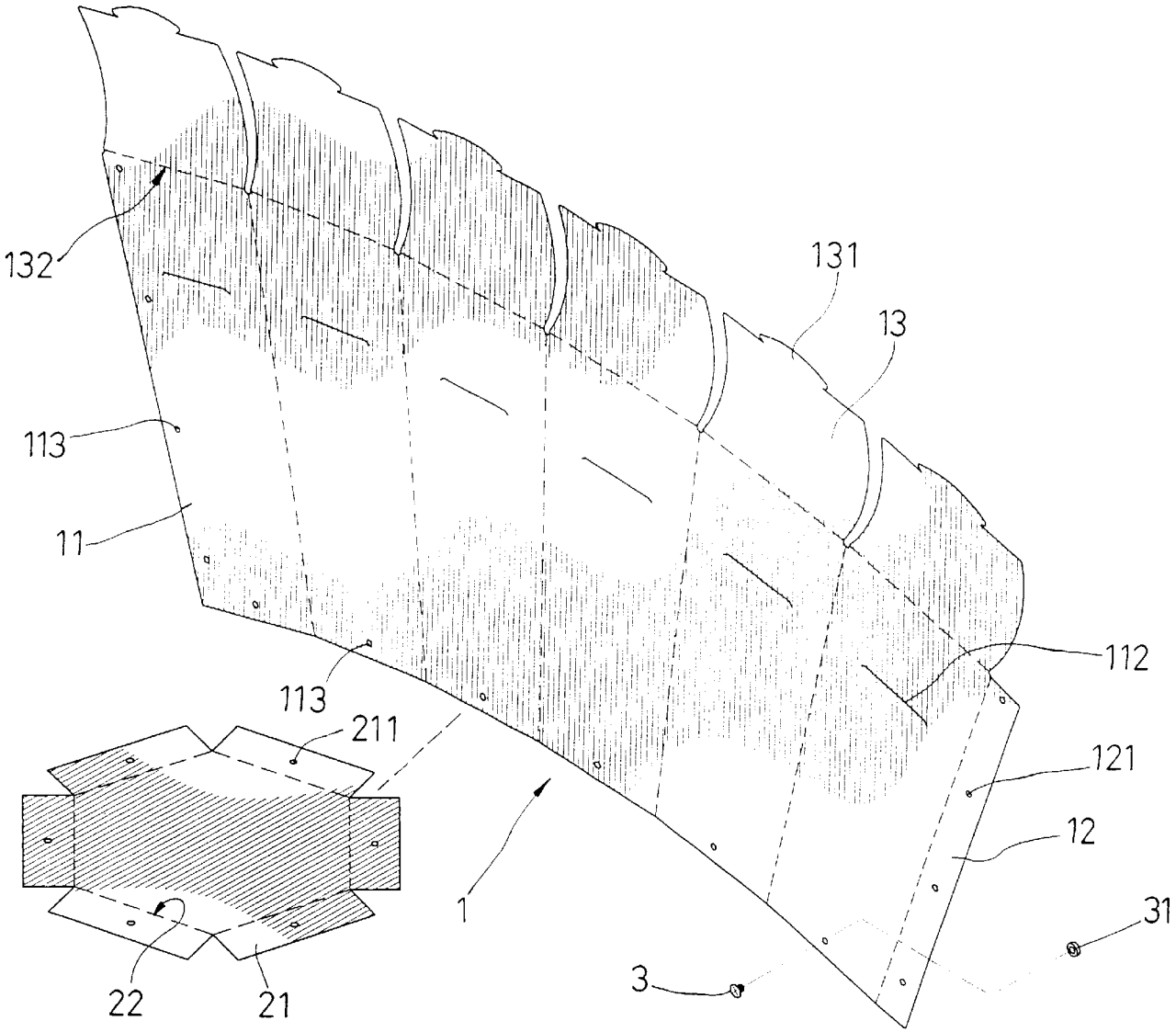
FIG. 3 is another perspective exploded view of a barrel of a preferred embodiment in accordance with the present invention.
Figure 4:
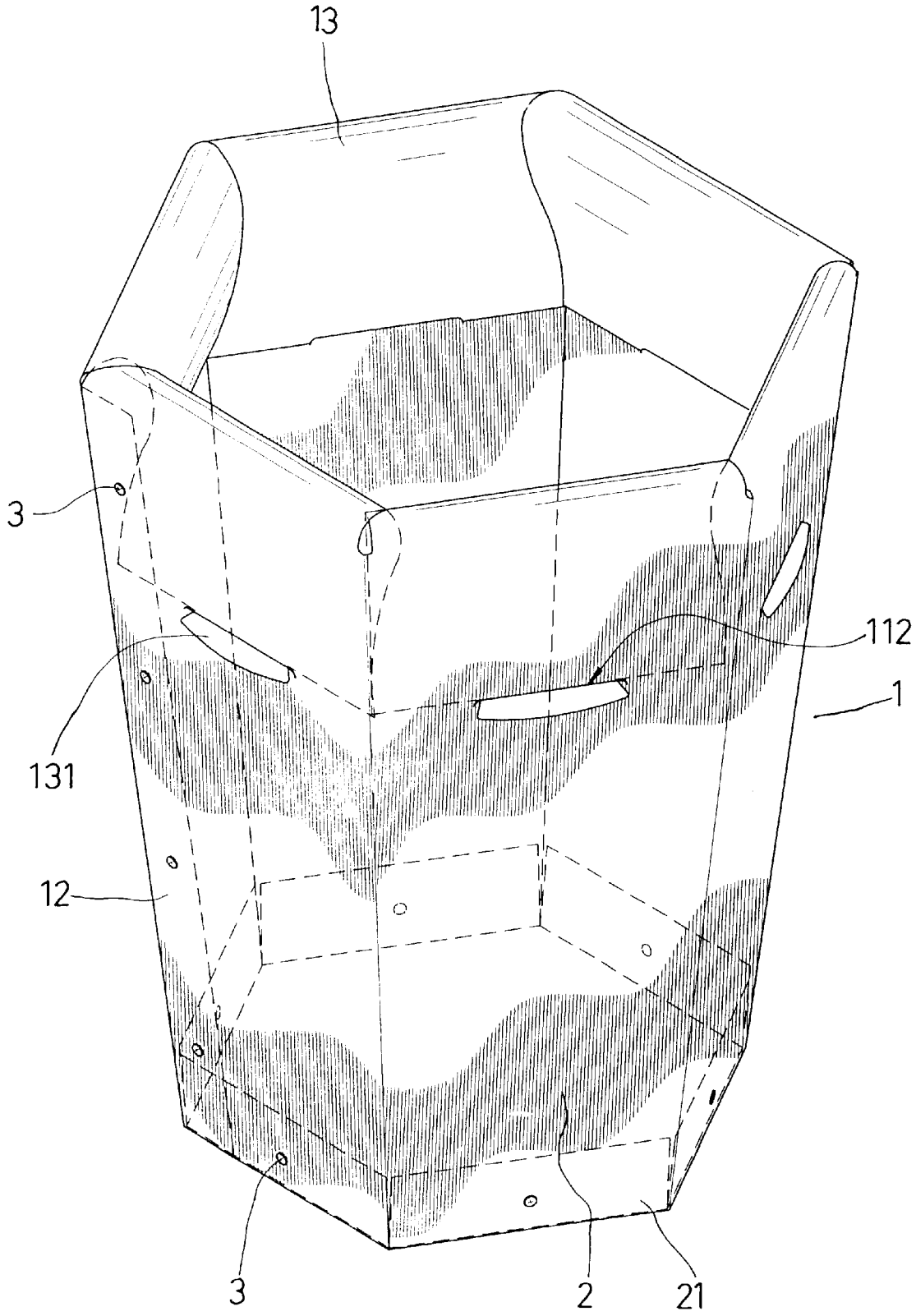
FIG. 4 is a perspective assembly view of a barrel of a preferred embodiment in accordance with the present invention.
Figure 5:
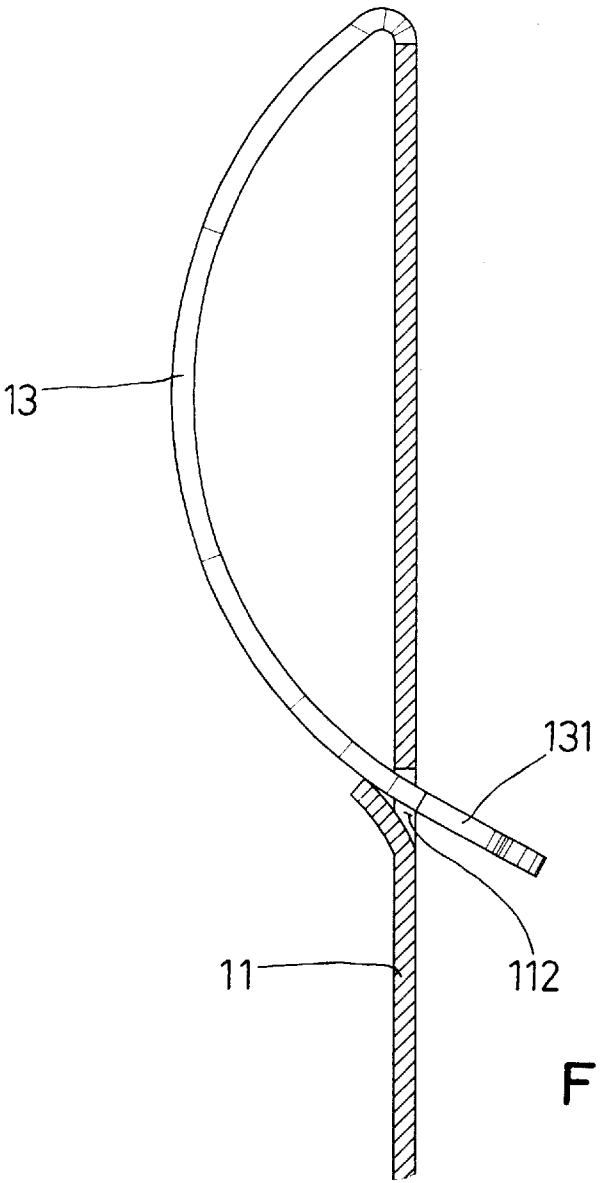
FIG. 5 is a schematic view illustrating an insertion portion of a decoration plate inserted in a slot of a sector-shaped main board of a preferred embodiment in accordance with the present invention.
Figure 6:
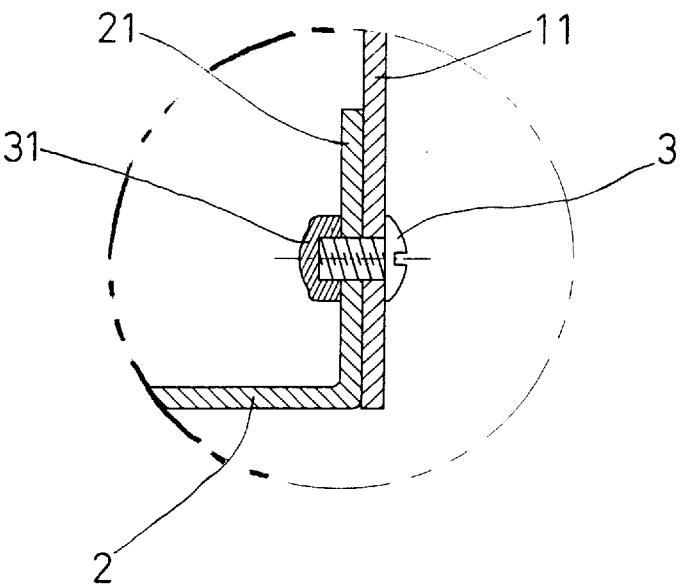
FIG. 6 is a schematic view illustrating a sector-shaped main board and a polygonal base board are fastened together.

Referring to FIGS. 1 to 6, a barrel comprises a sector-shaped main board 1 and a polygonal base board 2.

A plurality of periphery plates 21 are disposed on a periphery of the polygonal base board 2.

Each of the periphery plates 21 has a periphery folding line 22 and a round hole 211.

The sector-shaped main board 1 has a plurality of longitudinal folding lines 111, a connection plate 12 and a plurality of rectangular plates 11 defined by the longitudinal folding lines 111, and a plurality of decoration plates 13 connected to the rectangular plates 11.

The connection plate 12 has a plurality of round apertures 121.

Each of the rectangular plates 11 has a slot 112 and at least a circular aperture 113.

Each of the decoration plates 13 has a transverse folding line 132 and an insertion protrusion 131.

The sector-shaped main board 1 is folded along the longitudinal folding lines 111.

The connection plate 12 and one of the rectangular plates 11 are fastened together.

Each of the decoration plates 13 is folded along the transverse folding line 132 and the insertion protrusion 131 of the decoration plate 13 is inserted in the corresponding slot 112 of the rectangular plate 11.

Each of the periphery plates 21 is folded upward along the periphery folding line 22 to match the corresponding rectangular plate 11.

Each of the periphery plates 21 and each of the rectangular plates 11 are fastened together by a bolt 3 and a nut 31 engaging with the bolt 3.

When the barrel is turned upside down, the barrel is converted into a lamp shade.

The invention is not limited to the above embodiment but various modification thereof may be made. Further, various changes in form and detail may be made without departing from the scope of the invention.

I claim:

1. A barrel comprises:

a sector-shaped main board and a polygonal base board, a plurality of periphery plates disposed on a periphery of the polygonal base board, each of the periphery plates having a periphery folding line and a round hole, the sector-shaped main board having a plurality of longitudinal folding lines, a connection plate and a plurality of rectangular plates defined by the longitudinal folding lines, and a plurality of decoration plates connected to the rectangular plates, the connection plate having a plurality of round apertures, each of the rectangular plates having a slot and at least a circular aperture, each of the decoration plates having a transverse folding line and an insertion protrusion, the sector-shaped main board folded along the longitudinal folding lines, the connection plate and one of the rectangular plates fastened together, each of the decoration plates folded along the transverse folding line and the insertion protrusion of the decoration plate inserted in the corresponding slot of the rectangular plate, each of the periphery plates folded upward along the periphery folding line to match the corresponding rectangular plate, and each of the periphery plates and each of the rectangular plates fastened together by a bolt and a nut engaging with the bolt.

* * * * *